US008308029B2

(12) United States Patent
Ki

(10) Patent No.: US 8,308,029 B2
(45) Date of Patent: Nov. 13, 2012

(54) DISPENSER

(75) Inventor: Joong Hyun Ki, Incheon (KR)

(73) Assignee: Yonwoo Co., Ltd. (KR)

( * ) Notice: Subject to any disclaimer, the term of this patent is extended or adjusted under 35 U.S.C. 154(b) by 1092 days.

(21) Appl. No.: 12/293,401

(22) PCT Filed: May 4, 2007

(86) PCT No.: PCT/KR2007/002199

§ 371 (c)(1),
(2), (4) Date: Sep. 17, 2008

(87) PCT Pub. No.: WO2008/010640

PCT Pub. Date: Jan. 24, 2008

(65) Prior Publication Data

US 2009/0071985 A1 Mar. 19, 2009

(30) Foreign Application Priority Data

Jul. 19, 2006 (KR) ..... 20-2006-0019430 U

(51) Int. Cl.
*B67B 1/00* (2006.01)

(52) U.S. Cl. ..... 222/309; 222/153.13; 222/182; 222/183; 222/256; 222/286; 222/321.9; 222/385

(58) Field of Classification Search ..... 215/28; 220/8, 724, 915; 222/153.13–153.14, 182–184, 222/309, 321.1, 321.7–321.9, 402.11–402.12, 222/519, 256–257, 285–287, 321.7–321.9, 222/383.1–383.3, 384–385, 402.11–402.12
See application file for complete search history.

(56) References Cited

U.S. PATENT DOCUMENTS

| | | | | |
|---|---|---|---|---|
| 4,889,262 | A * | 12/1989 | Toms | 222/153.13 |
| 5,499,747 | A * | 3/1996 | Quennessen | 222/167 |
| 6,290,103 | B1 * | 9/2001 | Fraillon | 222/321.1 |
| 6,905,049 | B1 * | 6/2005 | Lambert | 222/321.7 |
| 7,874,461 | B2 * | 1/2011 | Bae | 222/153.13 |

FOREIGN PATENT DOCUMENTS

| | | |
|---|---|---|
| JP | 05-061058 | 8/1993 |

* cited by examiner

*Primary Examiner* — Kevin P Shaver
*Assistant Examiner* — Andrew P Bainbridge
(74) *Attorney, Agent, or Firm* — Cantor Colburn LLP

(57) ABSTRACT

A dispenser has a reservoir to hold a fluid, in at least one embodiment a viscous cosmetic, with a pump and a set of groove protrusions attached integrally. The dispenser fits within an outer casing that houses the reservoir and has a set of grooved passages with a flat upper section, a flat lower section, and a slope in between which seat the set of groove protrusions. The dispenser is raised and lowered within the outer casing with a hollow rotating body that has a set of straight grooves that simultaneously seat the set of groove protrusions so that when the hollow rotating body is twisted on top of the outer casing, the dispenser can move up or down. The hollow rotating body also has a notch to seat a button and nozzle actuating top when the dispenser is rotated to its lowest position. When the button and nozzle are depressed, fluid is dispensed through the nozzle. More or less fluid is dispensed depending on how high the dispenser is raised with respect to the outer casing.

1 Claim, 3 Drawing Sheets

DISPENSER

TECHNICAL FIELD

The present invention relates, in general, to dispensers and, more particularly, to a dispenser which is constructed such that the amount of contents that is discharged can be easily adjusted, and such that it is convenient to use.

BACKGROUND ART

Generally, dispensers, which discharge a predetermined amount of liquid- or gel-phase contents, such as a cosmetic, at one time using pneumatic pressure, are classified into a dip tube type dispenser, in which some of the contents is drawn into a dip tube and is discharged from casing while the same volume of air is drawn into the casing, and an airless type dispenser, in which a piston is moved upwards by vacuum pressure and contents are thus pushed upwards.

FIG. 1 shows an example of a conventional airless type dispenser. As shown in the drawing, the conventional airless type dispenser includes a container 2, which stores contents therein, a dispenser cap 10, which is coupled to the upper end of the container 2 and pumps the stored contents, and a button 20, which protrudes from the upper end of the dispenser cap 10 so as to be movable upwards and downwards. A nozzle 22, through which contents pumped by the button are discharged outside the container, is provided at a predetermined position in the button 20. The dispenser further includes an outer lid 6, which covers the button 20 and the dispenser cap 10.

Furthermore, a cylinder 12, which extends to the contents in the container 2, is provided in the dispenser cap 10. A hollow shaft 14 and an inner cap 16, which are coupled to a stem 24 provided on the lower end of the button 20, are open at first ends thereof, and have a through hole 13 at a predetermined position, are also provided in the dispenser cap 10. The hollow shaft 14 and an inner cap 16 are moved upwards and downwards in the cylinder 12 to create vacuum pressure for discharging contents, drawn into the cylinder 12, outside the container. As well, an inlet 12*a*, which is openably closed by a ball valve 18 made of metal, is formed in the lower end of the cylinder 12. A spring 19, which supports the hollow shaft 14 upwards, is interposed between the inlet 12*a* and the hollow shaft 14. In the drawing, the reference numeral 1 denotes a piston, which is provided in the container 2 and is moved upwards by vacuum pressure.

In the conventional dispenser having the above-mentioned construction, a user separates the outer lid 6 from the container 2 and thereafter pushes the button 20. Then, the piston 1 compresses the contents, thereby some of the contents is discharged from the container 2. Here, depending on the case, the amount of contents that is required may vary. However, in the case of this dispenser, when the button 20 is pushed, because the piston 1 moves a constant distance, the same amount of contents is always discharged, regardless of the amount of the contents that is required. Furthermore, it is very difficult for the user to control the distance that the button 20 is moved when pushing the button 20. As such, the conventional dispenser is problematic in that it is difficult to adjust the amount of contents that is discharged.

DISCLOSURE OF INVENTION

Technical Problem

Accordingly, the present invention has been made keeping in mind the above problems occurring in the prior art, and an object of the present invention is to provide a dispenser which can conveniently discharge contents, adjust the amount of contents that is discharged, and prevent the loss of elements.

Technical Solution

The present invention is constructed such that the operating distance to which a piston is moved to discharge contents can be adjusted to control the amount of contents that is discharged.

Advantageous Effects

In the dispenser according to the present invention, the method of discharging contents is convenient, and the amount of contents that is discharged can be easily adjusted. As well, the present invention can prevent the loss of parts.

BEST MODE FOR CARRYING OUT THE INVENTION

Figure 1:
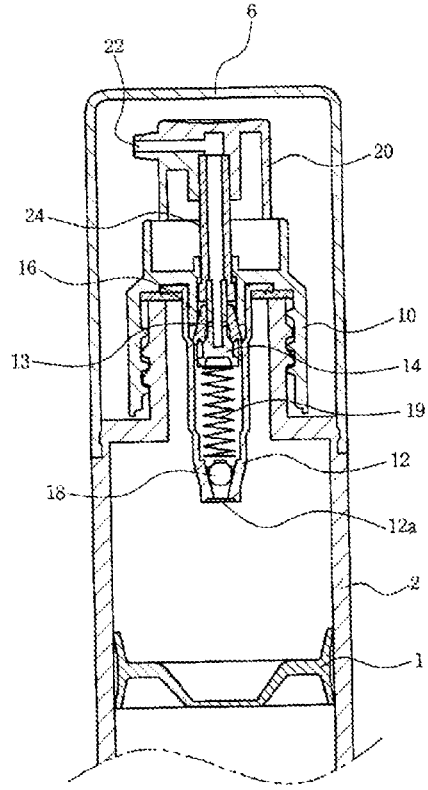
Fig. 1 Prior Art
FIG. 1 is a sectional view showing an example of a conventional dispenser.
Figure 2:
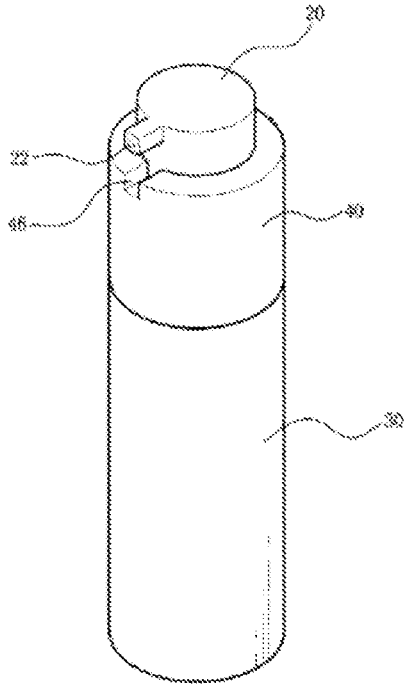
FIG. 2 is a perspective view of a dispenser, according to an embodiment of the present invention.

In order to accomplish the above object, the present invention provides a dispenser, comprising a container (2) to store contents therein, a dispenser cap (10) coupled to an upper end of the container (2) to pump the contents, a button (20) coupled to an upper end of the dispenser cap (10) so as to be movable in a longitudinal direction, with a nozzle (22) provided at a predetermined position in the button (20), and an outer casing (30) surrounding the container (2), wherein a plurality of guide slots (32), upper ends of which differ in height from each other, and lower ends of which are coupled to each other, is formed in an upper end of the outer casing (30), with a horizontal extension slot (34) extending from an upper end of each of the plurality of guide slots (32), a hollow rotating body (40) is rotatably coupled to the upper end of the outer casing (30), with a guide groove (42) formed in a circumferential inner surface of the hollow rotating body (40) in a longitudinal direction, and a guide protrusion (11) is provided on a circumferential outer surface of the dispenser cap (10), the guide protrusion (11) being inserted into the guide groove (42) through a corresponding guide slot (32), so that, when the hollow rotating body (40) is rotated with respect to the outer casing (30) in one direction, the guide protrusion (11) of the dispenser cap (10) is moved upwards along the corresponding guide slot (32) and the guide groove (42) and is inserted into the corresponding horizontal extension groove (34), thus adjusting a distance that the button (20) is movable downwards, thereby adjusting an amount of the contents that is discharged.

MODE FOR THE INVENTION

The above object, features and advantages of the present invention will be more clearly understood from the following detailed description. Hereinafter, a preferred embodiment of the present invention will be described with reference to the drawings.

As shown in FIGS. 2 through 5, a dispenser according to the present invention includes a container 2, in which contents are stored, a dispenser cap 10, which is coupled to the open upper end of the container 2 to pump the contents, and a button 20, which is coupled to the upper end of the dispenser cap 10 so as to be movable upwards and downwards and has a double tube structure. A nozzle 22 is provided at a predetermined position in the button 20. The dispenser cap 10 includes a cylinder 12, which extends from the inner surface of the dispenser cap body downwards into the container 2 and has an inlet 12*a* in the lower end thereof, and a hollow rotating body 40 and an inner cap 16, which are coupled to a stem 24 provided under the button 20 so as to be movable upwards and downwards in the cylinder 12. The dispenser cap 10 further includes a ball valve 18, which opens or closes the inlet 12*a* of the cylinder 12, a spring 19, which is interposed between the inlet 12*a* and the hollow shaft 14 and supports the hollow shaft 14, the inner cap 16 and the button 20 upwards, and a piston 1, which is provided in the container 2 such that it is moved upwards by vacuum pressure. The above-mentioned construction of the dispenser cap is the same as that of the conventional art.

Furthermore, a pair of guide protrusions 11 is provided around the circumferential outer edge of the dispenser cap 10 on the upper end of the container 2. The guide protrusions 11 are moved upwards or downwards along guide grooves 42 and guide slots 32, which will be explained later herein, such that the container 2 can be moved upwards or downwards.

Furthermore, the container 2 is placed in an outer casing 30, which surrounds the container 2, so as to be movable upwards or downwards. A plurality of guide slots 32 is formed in the upper end of the outer casing 30. In this embodiment, two adjacent guide slots 32 form an approximate V shape, in which the two guide slots are connected at the lower ends thereof to each other and are inclined such that they are moved away from each other from the bottom to the top. However, the shape of the guide slots is not limited to this. Here, the upper ends of the two guide slots 32 differ in height. Furthermore, a horizontal extension slot 34 horizontally extends from the upper end of each guide slot 32. While the guide protrusions 11 of the dispenser cap 10 are placed in the horizontal extension slots 34, when the button 20 is pushed, the dispenser cap 10 is prevented from being moved downwards along the guide slots 32, so that the container 2 maintains the position thereof. Therefore, when the user pushes the button 20, contents can be discharged from the container.

The guide protrusions 11 of the dispenser cap 10, which pass through the corresponding guide slots 32 of the outer casing 30, are slidably coupled to the guide grooves 42 of the hollow rotating body 40. Thus, when the user rotates the hollow rotating body 40, the guide protrusions 11 move upwards or downwards along the corresponding guide slots 32 of the outer casing 30 such that the container 2 is moved upwards or downwards without rotating.

In the drawings, reference numeral 46 denotes a seating notch, through which the nozzle 22 of the button 20 is seated into the hollow rotating body 40 when the hollow rotating body 40 is rotated.

In the dispenser according to the present invention having the above-mentioned construction, when the user rotates the hollow rotating body 40, the guide protrusions 11 of the dispenser cap 10 are moved upwards or downwards along the corresponding guide slots 32 and the respective guide grooves 42. Thereby, the container 2, which is coupled to the dispenser cap 10, and the button 20 are moved upwards or downwards, so that the height to which the nozzle 22, provided on the upper end of the button 20, protrudes from the hollow rotating body 40 can be adjusted.

Figure 3:
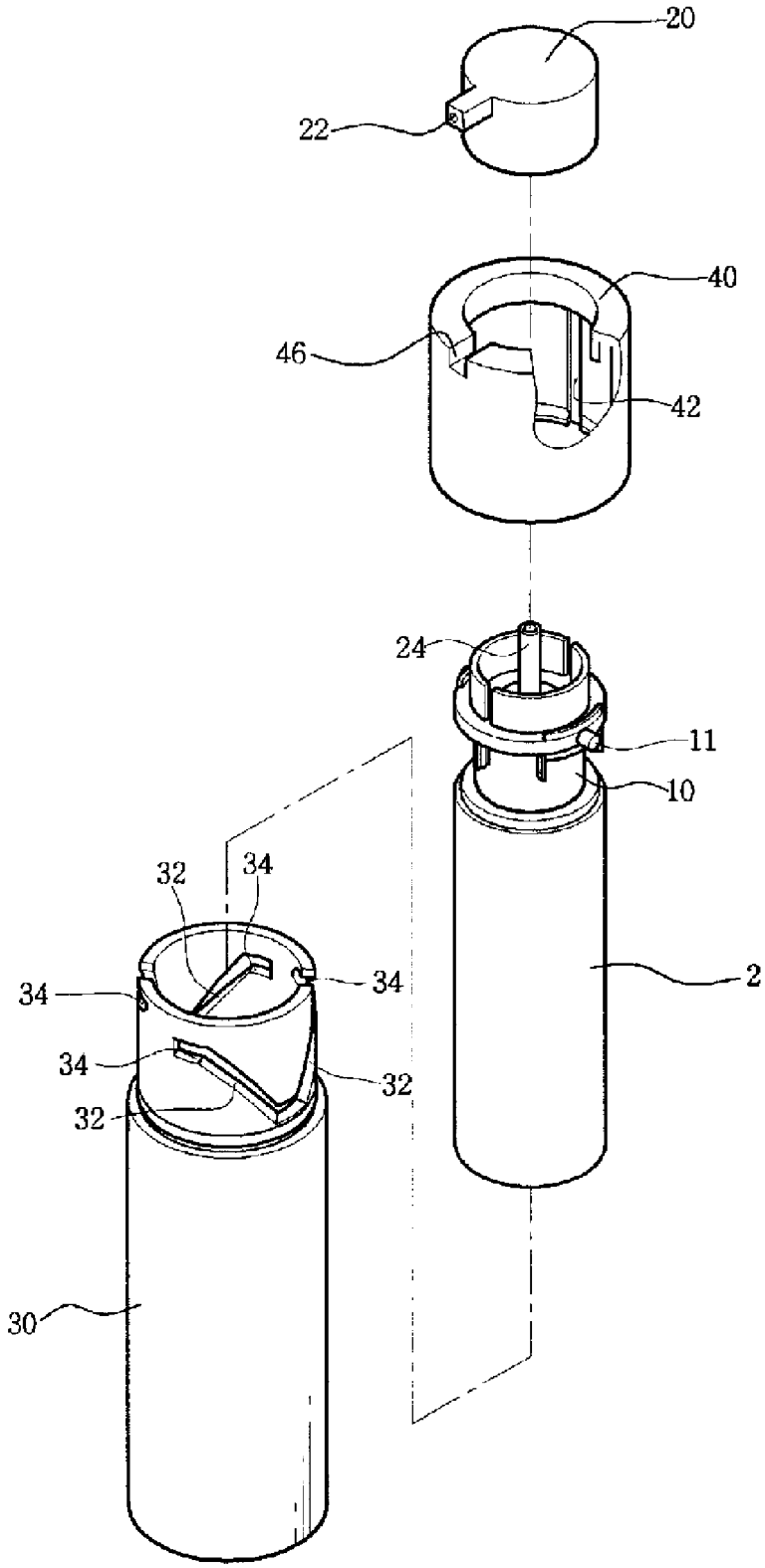
FIG. 3 is an exploded perspective view of the embodiment of the present invention.
Figure 4:
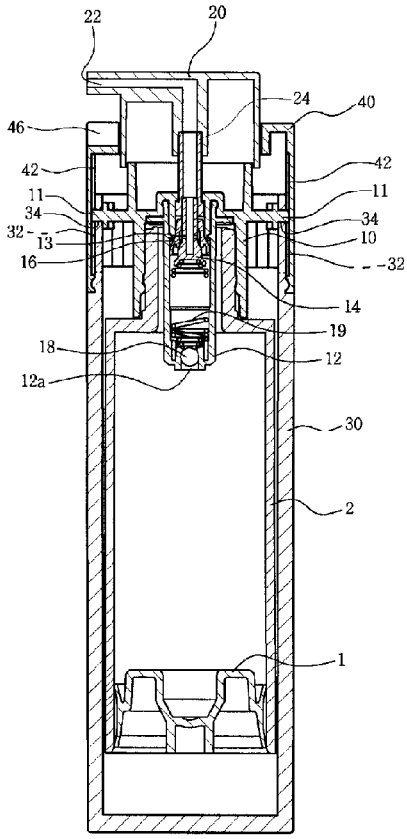
FIG. 4 is a sectional view showing the state in which a button is extracted according to the present invention.
Figure 5:
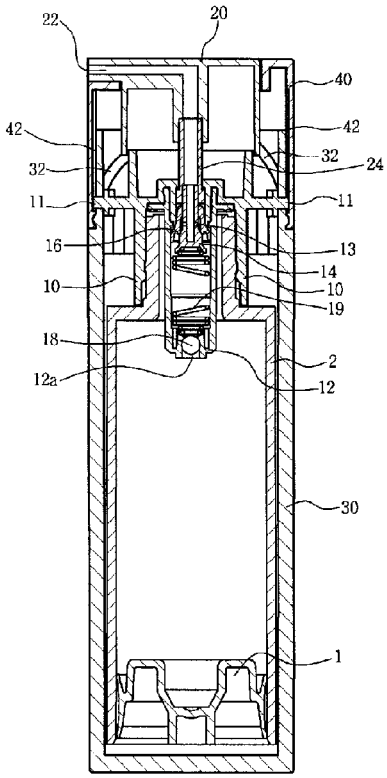
FIG. 5 is a sectional view showing the state in which a button is retracted according to the present invention.

Furthermore, referring to FIG. 3, when the user desires to discharge a relatively large amount of contents, the hollow rotating body 40 is rotated in a predetermined direction, that is, towards the guide slots 32 having the horizontal extension slots 34 at higher positions, such that the button 20 protrudes further upwards. At this time, the guide protrusions 11 are placed in the corresponding horizontal extension slots 34, so that the container 2 is maintained at the position thereof. The button 20 protrudes from the hollow rotating body 40 to a relatively high position. Therefore, when the user pushes the button 20 to discharge contents, because the distance that the button 32 can be moved downwards is relatively long, a relatively large amount of contents is discharged.

In contrast, when the user desires to discharge a relatively small amount of contents, the hollow rotating body 40 is rotated in a reverse direction, that is, towards the guide slots 32 having the horizontal extension slots 34 at lower positions, such that the button 20 protrudes upwards to a relatively lower position. At this time, the guide protrusions 11 are placed in the corresponding horizontal extension slots 34, so that the container 2 is maintained in position thereof. The button 20 protrudes from the hollow rotating body 40 to a relatively low position, compared to the prior case. Therefore, when the user pushes the button 20 to discharge contents, because the distance that the button 32 can be moved downwards is relatively short, a relatively small amount of contents is discharged.

As such, in the present invention, guide slots 32, the upper ends of which differ in height from each other, and the lower ends of which are coupled to each other, are formed in the outer casing 30. In addition, the horizontal extension slots 34 extend from the respective upper ends of the guide slots 32, which are formed at different heights. Therefore, the distance to which the button 20 is movable downwards is adjusted by rotating the hollow rotating body 40 in a desired direction, thus adjusting the amount of contents that can be discharged.

Furthermore, after a desired amount of contents is discharged from the dispenser, the hollow rotating body 40 is rotated at a predetermined angle such that the button 20 is seated in the hollow rotating body 40. Therefore, compared to the conventional art, which is constructed such that the outer lid is removed from or coupled to the container, the present invention is very convenient to use. In addition, in the conventional art, after the outer lid has been removed from the container, there is the possibility of loss of the outer lid. However, in the present invention, there is no possibility of loss of parts of the dispenser.

Meanwhile, in this embodiment, although a structure such that two adjacent guide slots 32 are coupled at the lower ends thereof to each other has been illustrated as one example, if necessary, the invention may be constructed such that three or more adjacent guide slots 32 are coupled to each other at upper or lower ends or at medial positions thereof.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

INDUSTRIAL APPLICABILITY

As described above, the present invention provides a dispenser in which a plurality of guide slots 32, the upper ends or lower ends of which are connected to each other, is formed in an outer casing 30, and horizontal extension slots 34 extend from the respective guide slots 32 to different heights. When the guide protrusions 11 of a dispenser cap 10 are placed in the horizontal extension slots 34, a container 2 is maintained in position. Thus, the distance to which a button 20 and a piston 1, which is moved downwards by the button 20, are moved downwards can be adjusted. Therefore, there is an advantage in that the amount of contents that is discharged can be easily adjusted.

Furthermore, the present invention is constructed such that, when the hollow rotating body 40 is rotated in the reverse direction after a desired amount of contents is discharged, the button 20 is seated in the hollow rotating body 40. Therefore, the invention is very convenient to use. In addition, because no part is separated from the dispenser when it is used, there is no possibility of loss of parts.

The invention claimed is:

1. A dispenser, comprising a container (2) to store contents therein, a dispenser cap (10) coupled to an upper end of the container (2) to pump the contents, a button (20) coupled to an upper end of the dispenser cap (10) so as to be movable in a longitudinal direction, with a nozzle (22) provided at a predetermined position in the button (20), and an outer casing (30) surrounding an entire portion of the container (2), wherein a plurality of guide slots (32), upper ends of which differ in height from each other, and lower ends of which are coupled to each other, is formed in an upper end of the outer casing (30), with a horizontal extension slot (34) extending from an upper end of each of the plurality of guide slots (32), a hollow rotating body (40) is rotatably coupled to the upper end of the outer casing (30), with a guide groove (42) formed in a circumferential inner surface of the hollow rotating body (40) in a longitudinal direction, and a guide protrusion (11) is provided on a circumferential outer surface of the dispenser cap (10), the guide protrusion (11) being inserted into the guide groove (42) through a corresponding guide slot (32), so that, when the hollow rotating body (40) is rotated with respect to the outer casing (30) in one direction, the guide protrusion (11) of the dispenser cap (10) is moved upwards or downwards, along the corresponding guide slot (32) and the guide groove (42) to move the button (20) coupled to the upper end of the dispenser cap (10) upwards or downwards and is inserted into a corresponding horizontal extension slot (34), thus adjusting a height to which the nozzle (22) of the button (20) is protruded from the hollow rotating body (40), thereby adjusting an amount of the contents that is discharged, the hollow rotating body (40) including a seating notch (46), through which the nozzle (22) of the button (20) is seated into the hollow rotating body (40) when the hollow rotating body (40) is at a lowest position.

* * * * *